US005379195A

United States Patent [19]

Epstein

[11] Patent Number: 5,379,195

[45] Date of Patent: Jan. 3, 1995

[54] LIGHTING FIXTURE

[75] Inventor: J. Michael Epstein, Houston, Tex.

[73] Assignee: RMS Lighting, Inc., Houston, Tex.

[21] Appl. No.: 19,605

[22] Filed: Feb. 19, 1993

[51] Int. Cl.[6] ..... F21V 19/04

[52] U.S. Cl. ..... 362/20; 362/183; 362/191; 362/226

[58] Field of Search ..... 362/20, 183, 186, 190, 362/191, 226

[56] References Cited

U.S. PATENT DOCUMENTS

| | | | |
|---|---|---|---|
| 3,125,300 | 3/1964 | Roche | 362/20 |
| 4,156,891 | 5/1979 | Roche | 362/20 |
| 4,631,649 | 12/1986 | McCue et al. | 362/20 X |

OTHER PUBLICATIONS

Chloride Systems; 6-Volt Explosion-proof Power Pack and Emergency Lighting Fixtures Brochure; 1976.

Crouse-Hinds; ELPS Emergency Lighting System Brochure; Sep. 1987.

Dual Lite; Explosion Proof Series Brochure; no publication date given.

American Electric; HAZBATT-Fluorescent Emergency Lighting System for Hazardous Locations and Adverse Environments, Nov. 1, 1992.

Killark Electric; HOSTILELITE-Incandescent/-Fluorescent Fixtures For Hazardous and Hostile Locations Product Bulletin, no pub. date given.

RMS Lighting Inc.; Emergency Lighting for Classified hazardous Area and Industrial Use, no publication date given.

Standby Systems, Inc.; Special Standby Units for Hazardous Locations, no publication date given.

*Primary Examiner*—Stephen F. Husar

*Attorney, Agent, or Firm*—Vaden, Eickenroht, Thompson, Boulware & Feather

[57] ABSTRACT

There is disclosed an improved battery backed-up explosion proof, safety lighting fixture for illuminating an area containing ignitable materials. The lighting fixture is portable and can be converted to an exit light.

6 Claims, 3 Drawing Sheets

LIGHTING FIXTURE

BACKGROUND OF THE INVENTION

1. Field of the Invention

This invention relates generally to lighting fixtures for illuminating an area containing ignitable materials. More particularly, this invention relates to an improved battery backed-up, explosion proof lighting fixture that will generate light in the event of a loss of the external power.

2. Description of the Prior Art

Regulation and codes dictate the type of lighting equipment that can be used in areas or environments containing ignitable material in attempts to prevent lighting fixtures from causing the ignitable materials to explode. For example, a spark generated by the lighting fixture could cause the material to explode. Therefore, the regulations are primarily directed to the housing of the fixture containing the light source.

Many types of lighting fixtures could be useful in the ignitable environments including, for example, main lighting fixture, exit lighting fixture, and safety lighting fixture. Main lighting fixtures are used to illuminate the entire area. Typically, self-powering exit lighting fixtures and safety lighting fixtures are designed to function in the event of a power failure. Exit lighting fixtures that emit sufficient light to identify the location of exits are positioned at the appropriate locations. Safety lighting fixtures function similarly to exit lighting fixtures, but typically emit more light than exit lighting fixtures. Since both the exit and safety lighting fixtures are used during power outages, most utilize batteries or some other self powering mechanism.

Many manufacturers market battery backed-up, explosion proof exit and safety lighting fixtures (hereinafter referred to as "prior art fixtures"). These lighting fixtures have some deficiencies most of which are associated with the designs and configurations of the these lighting fixtures. Most manufacturers manufacture two types of units: the single light unit and the multilight unit. The problems associated with the single light units are found in the multilight units as well. However, there are unique deficiencies associated with the multilight units. The following discussion on the deficiencies of the prior art fixtures is directed to both single unit safety and exit lighting fixtures unless otherwise specified.

One problem with the design of the prior art fixture design is that the battery is located external to the housing containing the light source. A typical fixture includes a lighting housing connected to a bracket that is mounted to a battery box. The battery box is designed to be permanently mounted to the wall or the support structure and typically includes several bolts or other types of locking mechanisms to maintain any electronics and the batteries therein. The entire fixture is usually very heavy and cumbersome to install.

Due to permanent installations and the location of the batteries of the prior art lighting fixtures, maintenance and replacement of the fixtures are sometimes time consuming and costly. For example, in order to replace or test the battery, the entire fixture, including the lighting housing, the bracket, and the battery box, should be removed in order to isolate the electronics from the ignitable material, and thus, maintain a fully explosion proof status. However, in practice, when repair or replacement of the electronics or batteries is necessary, the bolts or other locking mechanisms are removed from the battery box, thus exposing the ignitable material to the electronics and batteries. Therefore, the entire heavy lighting fixture must be removed to avoid a potential explosion during repair or maintenance.

Another problem with the prior art lighting fixtures is that the fixtures are permanently affixed to a wall or support structure end cannot be removed to illuminate other areas unreachable by the light from the permanently mounted fixtures. In some instances, it may be necessary to illuminate these other areas, for example, different passage ways may need to be illuminated during the evacuation of a building.

There is at least one problem that is exclusively associated with the multilight units, where at least two lamps are connected to the single remote battery. When the battery fails, so do all the lights attached to that battery.

Yet another problem with the prior art lighting fixture is that the lighting fixture is only illuminated when there is a loss of external power. In some instance, it is desirable to have safety lighting fixtures that are illuminated at all times.

Finally, the prior art light fixtures utilize incandescent bulbs as light sources. Incandescent bulbs are not as efficient as, for example, flourescent bulbs. Incandescent bulbs generally require quite a bit of power for illumination, which consequently requires a large battery. The life time of the incandescent bulb is not as long as flourescent, thus, requiring more frequent replacements.

Therefore, it is an object of this invention to provide a self contained, explosion proof lighting fixture to illuminate an area containing ignitable materials.

It is another object of the present invention to provide a multilight, self-contained, explosion proof lighting fixture, wherein the failure of one lighting fixture or battery will not cause the remaining fixture light to fail.

It is another object of the present invention to provide a portable exit or safety lighting fixture.

It is yet another object of the present invention to provide exit and safety lighting fixtures that are easily maintained and replaced.

It is another object of the present invention to provide an efficient, light weight exit or safety lighting fixture.

SUMMARY OF THE INVENTION

These and other objects are attained by a lighting fixture including a light source mounted in an explosion proof housing and powered from either an external power source or by a power storage cell mounted in the housing. Means for electrically connecting the power storage cell to the light source for illumination of the light source in response to loss of the external power to the light source is connected to the power storage cell and the external power source. The housing includes a portable case which is releasably connected to a mounting bracket and in which the light source and power storage cell are mounted having a window through which light may be transmitted. The housing also includes parts for electrically transmitting power from the external power source to the light source, the parts being engagable to transmit power to the light source, when the bracket and case are connected, and being disengagable when the bracket and case are disconnected so that the light source becomes powered by the power storage cell.

BRIEF DESCRIPTION OF THE DRAWINGS

In the drawings, wherein like reference characters are used throughout to designate like parts.

DESCRIPTION OF THE PREFERRED EMBODIMENT

Figure 1:
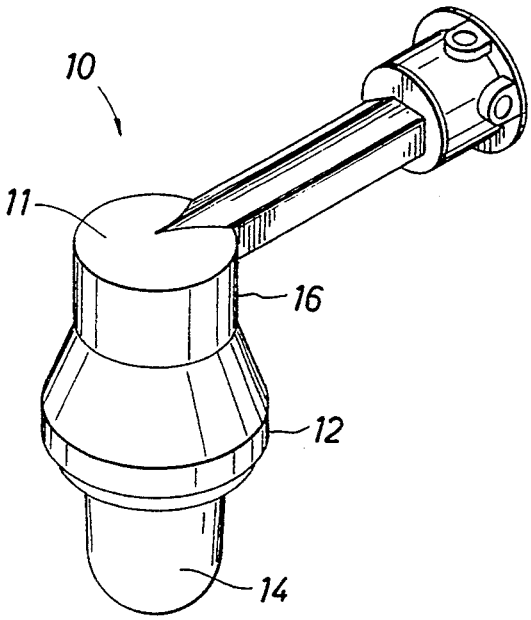
FIG. 1 is a perspective view of a single unit safety lighting fixture constructed in accordance with the present invention.
Figure 2:
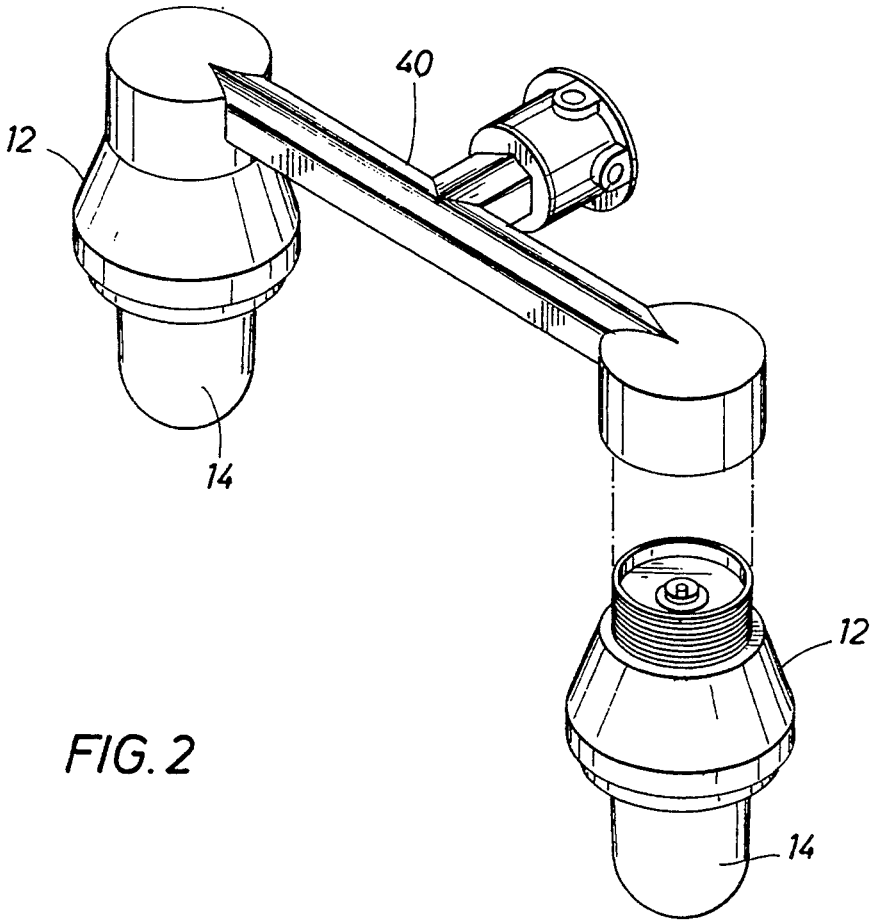
FIG. 2 is a perspective view of a dual unit safety lighting fixture constructed in accordance with the present invention.
Figure 3:
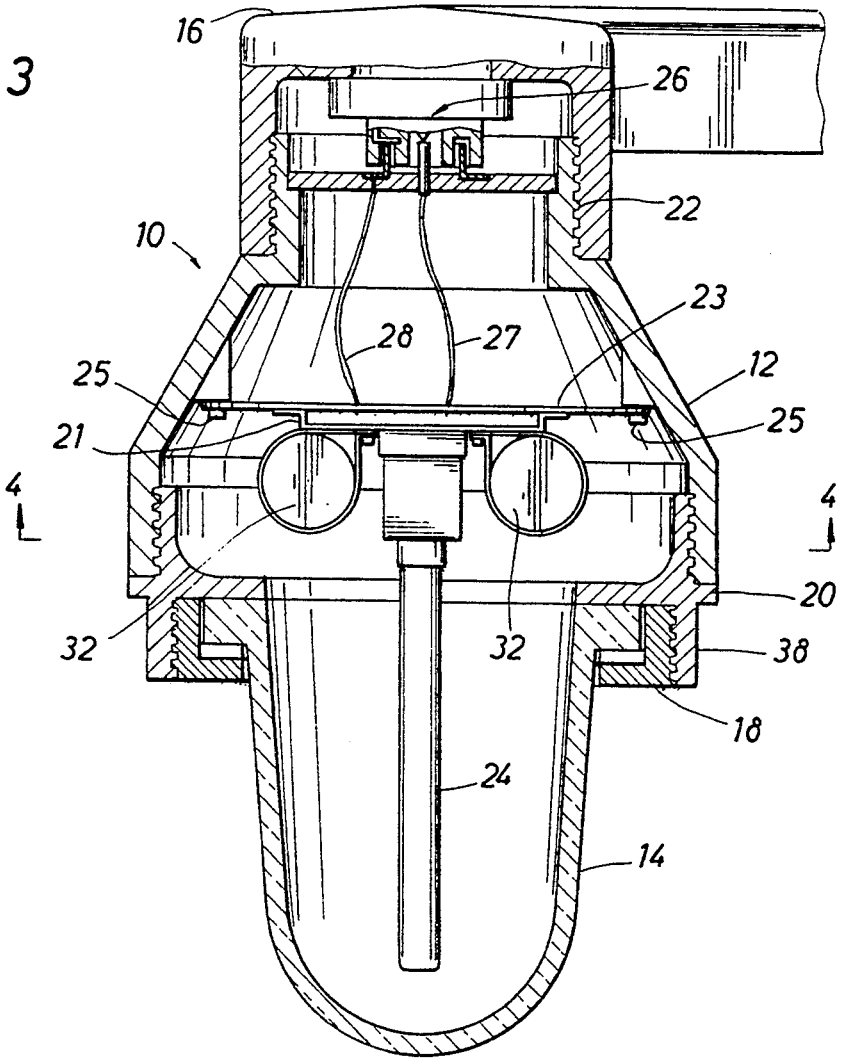
FIG. 3 is a cross-sectional view of the lighting fixture shown in FIG. 1.
Figure 4:
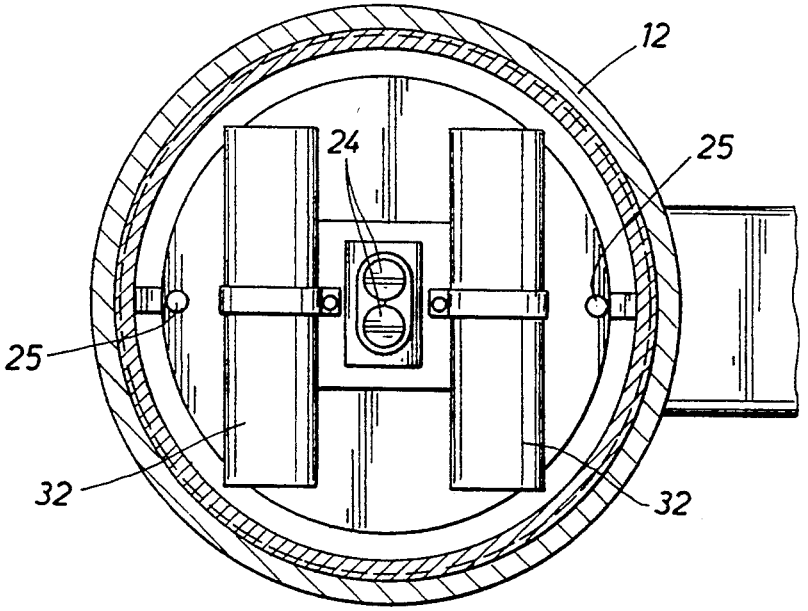
FIG. 4 is a cross-sectional view taken along the lines indicated in FIG. 3.

With reference now to the details of the above-described drawings, FIGS. 1, 2, and 3 show lighting fixture 10 that includes mounting bracket 16, a portable case 12 releasably connected to the bracket through thread 22, and a window 14 in the lower end of the case through which light may be transmitted. Window 14 is sealed in place in portable case 12 through threaded members 18 and 20.

Referring now to FIG. 3, a cross-section of lighting fixture 10 incorporating the light source 24 is shown. Light source 24 is attached to light source mounting plate 21, which is connected to circuit board mounting plate 23. Circuit board mounting plate 23 is removably mounted into portable case 12 by screws 25. Light source 24 is electrically connected to circuit board 30 which is mounted to circuit board mounting plate 23 (not shown).

Figure 5:
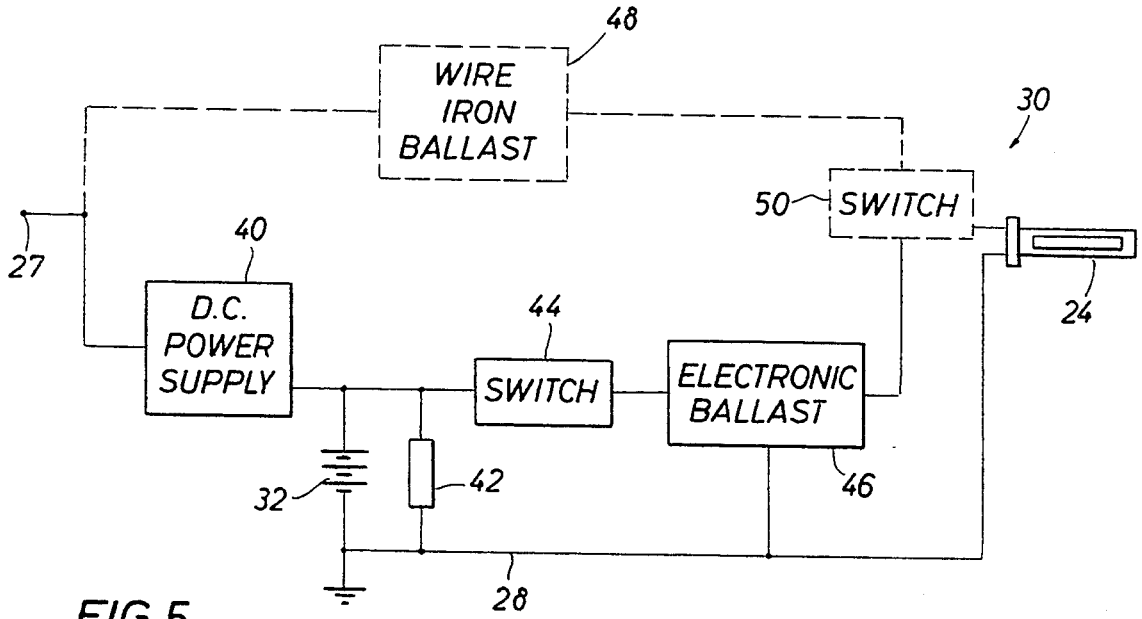
FIG. 5 is a schematic representation of the circuit that provides power from the storage cell to the light source in the event of loss of external power.

Sources of electrical power and ground (not shown) are available in mounting bracket 16 and are electrically connected to circuit board 30, when portable case 12 is mounted in bracket arm 16, through coaxial ring connector 26 and power and ground wires 27 and 28. Wires 27 and 28 apply power and ground, respectively, to circuit board 30, as shown in FIG. 5.

Storage cells 32 are also connected to circuit board 30 at the locations shown. In the preferred embodiment of this invention, the external power is only used to recharge batteries 32, and not to illuminate light source 24 when electrically connected to circuit board 30. Light source 24 is only illuminated by batteries 32, when a loss of external power is detected. Specifically, alternating current from the external power source is fed into direct current power supply 40 in order to product sufficient voltage to charge batteries 32 through charging circuit 42. When a loss of external power occurs on line 27, switching circuit 44 detects the loss and connects batteries 32 to electronic ballast 46, which included a starter and strike circuit to turn on the light source 24 and a transformer to maintain sufficient voltage across light source 24 to keep it illuminated. An electronic ballast is required because in the preferred embodiment of this invention light source 24 is a flourescent bulb. The electronic ballast is designed to illuminate the flourescent bulb to 100% capacity. All the elements in the circuit described above are well known to those of ordinary skill in the art and could easily be modified by one of ordinary skill in the art to accommodate an incandescent light source instead of a fluorescent light source.

The circuit could also be easily modified by one of ordinary skilled in the art to maintain light source 24 illuminated at times regardless of whether the power is from the external source or batteries 32 by including a second ballast 48 connected to light source 24 through switch 50, which provides power to light source 24 until a loss of power is detected, at which time the switch connects light source 24 to electronic ballast 46.

A loss of external power can be caused by external power source failure or the disconnection of the portable case 12 from mounting bracket 16. Therefore, in the event of a loss of external power, portable case housing light source 24 and powered battery 32 may be removed from the mounting bracket at threads 22, thereby creating a portable light source.

In the preferred embodiment of the invention, storage cells 32 are Powersonic Nicad 1.2 Volt rechargeable batteries. However, any type of device capable of storing energy in some form and of converting the stored energy to electrical energy when accessed, can be used. Also, ill the preferred embodiment of this invention, mounting bracket 16, portable case 12 and window 14 (to the extent thus far described) are manufactured by Killark Manufacturing Co., of St. Louis Miss., and known as Model No. EMI15A2G.

The design of light fixture 10 reduces maintenance of the lighting and repair cost fixture. Due to the interlocking threaded elements in the housing, light source 24 and batteries 32 can be easily replaced by removing threaded shoulder 20 from portable case 12.

Figure 6:
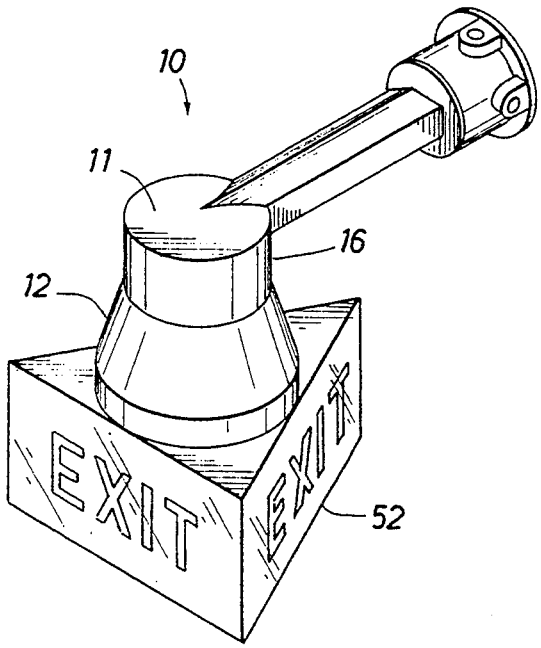
FIG. 6 is a perspective view of an exit dome used to convert the safety lighting fixture in FIGS. 1 and 2 into an exit lights in accordance with the present invention.

This particular emergency light can be easily transformed into an exit light by placing exit dome 52, shown in FIG. 6 over top of window 14. An opening on the top of the dome fits snugly around the outer edge of threaded member 20.

FIG. 2 shows two portable case 12 connected to a T-bar bracket arm 40. Each of the portable cases contain separate batteries, such that if one of the light sources fails, the other will continue to work. In the event that there is a loss of external power to both lamps, each is run from its respective battery and performs independently from the other.

From the foregoing, it will be seen that this invention is one well adapted to obtain all the ends and objects hereinabove set forth, together with other advantages which are obvious and which are inherent to the apparatus. For example, the circuit if FIG. 5 could easily be modified by one of ordinary skill in the art to include circuitry to allow for testing of the battery and light source, while external power is connected.

It will be understood that certain features and subcombinations are of utility and may be employed without reference to other features and subcombinations. This is contemplated by and is within the scope of the claims. As many possible embodiments may be made of the invention without departing from the scope thereof, it is to be understood that all matter herein set forth or shown in the accompanying drawings is to be interpreted as illustrative and not in a limiting sense.

I claim:

1. A light fixture for illuminating an area containing ignitable materials, comprising:

an explosion proof housing;

a bracket for removably mounting said housing in the area containing ignitable materials;

a light source mounted in the housing;

a power storage cell mounted in said housing;

means connected to said power storage cell, for transmitting power from an external source to said power storage cell for charging said power storage cell; and means connected to said power transmitting means for electrically connecting said power storage cell to said light source to illuminate said light source in response to loss of the external power source to said light source.

2. A light fixture in accordance with claim 1, wherein the housing includes a portable case in which the light source and power storage cell are mounted having a window through which light may be transmitted;

a mounting bracket releasably connected to the case; and parts being engagable to transmit power to said power transmitting means, when the bracket and case are connected, and being disengagable when the bracket and case are disconnected so that the light source becomes powered by said power storage cell.

3. Apparatus in accordance with claim 1, wherein said light source is a fluorescent bulb.

4. Apparatus in accordance with claim 1, additionally comprising means for illuminating said light source by said external source, when said external source is electrically connected to said power transmitting means.

5. A light fixture for illuminating an area containing ignitable materials, comprising:

an explosion proof housing;

a light source mounted in the housing;

a power storage cell mounted in said housing;

means connected to said power storage cell, for transmitting power from an external source to said power storage cell for charging said power storage cell; and means connected to said power transmitting means for electrically connecting said power storage cell to said light source to illuminate said light source in response to loss of the external power source to said light source; and wherein the housing includes a portable case in which the light source and power storage cell are mounted having a window through which light may be transmitted;

a mounting bracket releasably connected to the case; and parts being engagable to transmit power to said power transmitting means, when the bracket and case are connected, and being disengagable when the bracket and case are disconnected so that the light source becomes powered by said power storage cell.

6. A light fixture for illuminating an area containing ignitable materials, comprising:

an explosion proof housing;

a light source mounted in the housing;

a power storage cell mounted in said housing;

means connected to said power storage cell, for transmitting power from an external source to said power storage cell for charging said power storage cell;

means connected to said power transmitting means for electrically connecting said power storage cell to said light source to illuminate said light source in response to loss of the external power source to said light source; and means for illuminating said light source by said external source, when said external source is electrically connected to said power transmitting means.

* * * * *